US008550061B2

(12) United States Patent
Maeda

(10) Patent No.: US 8,550,061 B2
(45) Date of Patent: Oct. 8, 2013

(54) TOY GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 13/358,667

(22) Filed: Jan. 26, 2012

(65) Prior Publication Data

US 2013/0192574 A1 Aug. 1, 2013

(51) Int. Cl.
*F41B 11/00* (2013.01)

(52) U.S. Cl.
USPC ..... 124/56; 42/71.02; 124/74

(58) Field of Classification Search
USPC ..... 124/56, 74; 42/71.01
See application file for complete search history.

(56) References Cited

U.S. PATENT DOCUMENTS

| | | | | |
|---|---|---|---|---|
| 4,315,379 | A * | 2/1982 | Lang | 42/71.02 |
| 4,344,410 | A * | 8/1982 | Curran | 124/80 |
| 5,231,237 | A * | 7/1993 | Cupp | 42/71.02 |
| 6,029,645 | A * | 2/2000 | Wonisch et al. | 124/74 |
| 6,073,381 | A * | 6/2000 | Farrar et al. | 42/71.02 |
| 7,290,539 | B2 | 11/2007 | Maeda et al. | |
| 7,591,261 | B2 * | 9/2009 | Wei | 124/74 |
| 7,730,882 | B2 * | 6/2010 | Liu | 124/74 |
| 8,146,580 | B2 * | 4/2012 | Wei | 124/74 |
| 2006/0260596 | A1 * | 11/2006 | Maeda et al. | 124/74 |
| 2006/0288990 | A1 * | 12/2006 | Wei | 124/80 |
| 2007/0181116 | A1 * | 8/2007 | Wei | 124/74 |
| 2008/0141991 | A1 * | 6/2008 | Liu | 124/56 |
| 2008/0168974 | A1 * | 7/2008 | Kaminker et al. | 124/74 |
| 2009/0277436 | A1 * | 11/2009 | Wei | 124/74 |

FOREIGN PATENT DOCUMENTS

DE 20 2009 016 072 U1 3/2010

OTHER PUBLICATIONS

Extended European Search Report issued in corresponding European Patent Application No. 12000325.6, dated Jun. 28, 2012.

* cited by examiner

*Primary Examiner* — Samir Abdosh
*Assistant Examiner* — Derrick Morgan
(74) *Attorney, Agent, or Firm* — Rader, Fishman & Grauer PLLC

(57) ABSTRACT

A panel that conceals a gas cartridge attached to a toy gun is easily attached and detached without impairing the appearance of the toy gun. The gas cartridge is housed in a housing space formed in a cartridge housing portion and supplies compressed gas for firing a bullet. An introduction port for introducing the gas cartridge is provided in a first face of the cartridge housing portion. A working portion is provided in the cartridge housing portion and is moved in a direction along the first face. The panel is detachably attached to the cartridge housing portion and covers the introduction port. A protruded portion is extended from the lid portion of the panel. The protruded portion is provided with an inclined portion. The working portion is brought into slide contact with the inclined portion and moves the panel.

3 Claims, 13 Drawing Sheets

TOY GUN

BACKGROUND OF THE INVENTION

1. Field of the Invention

The present invention relates to a toy gun to which a gas cartridge filled with compressed gas can be attached and which fires a bullet utilizing the injection pressure of the compressed gas.

2. Description of Related Art

Toy guns to which a gas cartridge housing compressed gas, such as carbon dioxide, can be attached and which fire a bullet utilizing the injection pressure of the compressed gas conventionally exist. The compressed gas is discharged according to operation with the trigger provided in the toy gun. The compressed gas hits a bullet loaded in the toy gun. The bullet is thereby fired.

To conceal a gas cartridge attached to a toy gun, a panel may be attached to the toy gun. The panel is removed when the gas cartridge is replaced and is attached when the toy gun is used. The panel also functions to make the toy gun look like a real gun.

An example of the above-mentioned toy gun is the air gun G described in the specification of U.S. Pat. No. 7,290,539. FIG. 3 to FIG. 6 in the specification of U.S. Pat. No. 7,290,539 will be referred to. In the grip portion 1 of the air gun G, a cartridge housing portion 2 is formed. An opening for inserting a high-pressure gas cartridge A is formed in the cartridge housing portion 2. The opening is positioned in a side surface of the air gun G. A side grip panel 10 is detachably attached to the grip portion 1 to open or close the opening.

It is desirable that the panel concealing a gas cartridge should be easily attachable to and detachable from the toy gun.

Consideration will be given to providing a protrusion at the lower part of the side grip panel 10 as illustrated in FIG. 1, FIG. 3, and FIG. 4 in the specification of U.S. Pat. No. 7,290,539. In this case, a user of the air gun G can easily attach or detach the side grip panel 10 by pinching the protrusion. However, the protrusion is conspicuous in the appearance of the air gun G. The protrusion is obtrusive for a user who desires to enjoy a toy gun imitating the appearance of a real gun.

SUMMARY OF THE INVENTION

It is an object of the invention to make it possible to easily attach and detach a panel that is attached to a toy gun and conceals a gas cartridge, without impairing the appearance of the toy gun.

A toy gun of the invention includes: an air chamber body forming an air chamber for storing compressed gas; a discharge mechanism for discharging compressed gas in the air chamber; a cartridge housing portion forming a housing space for housing a gas cartridge filled with compressed gas; a cartridge attachment portion to which a gas cartridge housed in the cartridge housing portion is coupled and which guides compressed gas in the gas cartridge to the air chamber; an introduction port which is provided in a first face of the cartridge housing portion and through which the gas cartridge introduced into the housing space is passed; a working portion provided in the cartridge housing portion and moved in the direction along the first face; a panel having a lid portion for closing the introduction port and a protruded portion protruded from the lid portion and detachably attached to the cartridge housing portion with the protruded portion inserted into the introduction port; and an inclined portion which is provided on the protruded portion and with which the working portion is brought into slide contact.

According to the invention, the working portion is brought into slide contact with the inclined portion to push out the panel and the panel is removed from the cartridge housing portion. Therefore, it is possible to easily attach or detach the panel concealing a gas cartridge attached to a toy gun. Since the inclined portion is positioned in the cartridge housing portion, the appearance of the toy gun is not impaired.

DETAILED DESCRIPTION OF THE PREFERRED EMBODIMENTS

Figure 1:
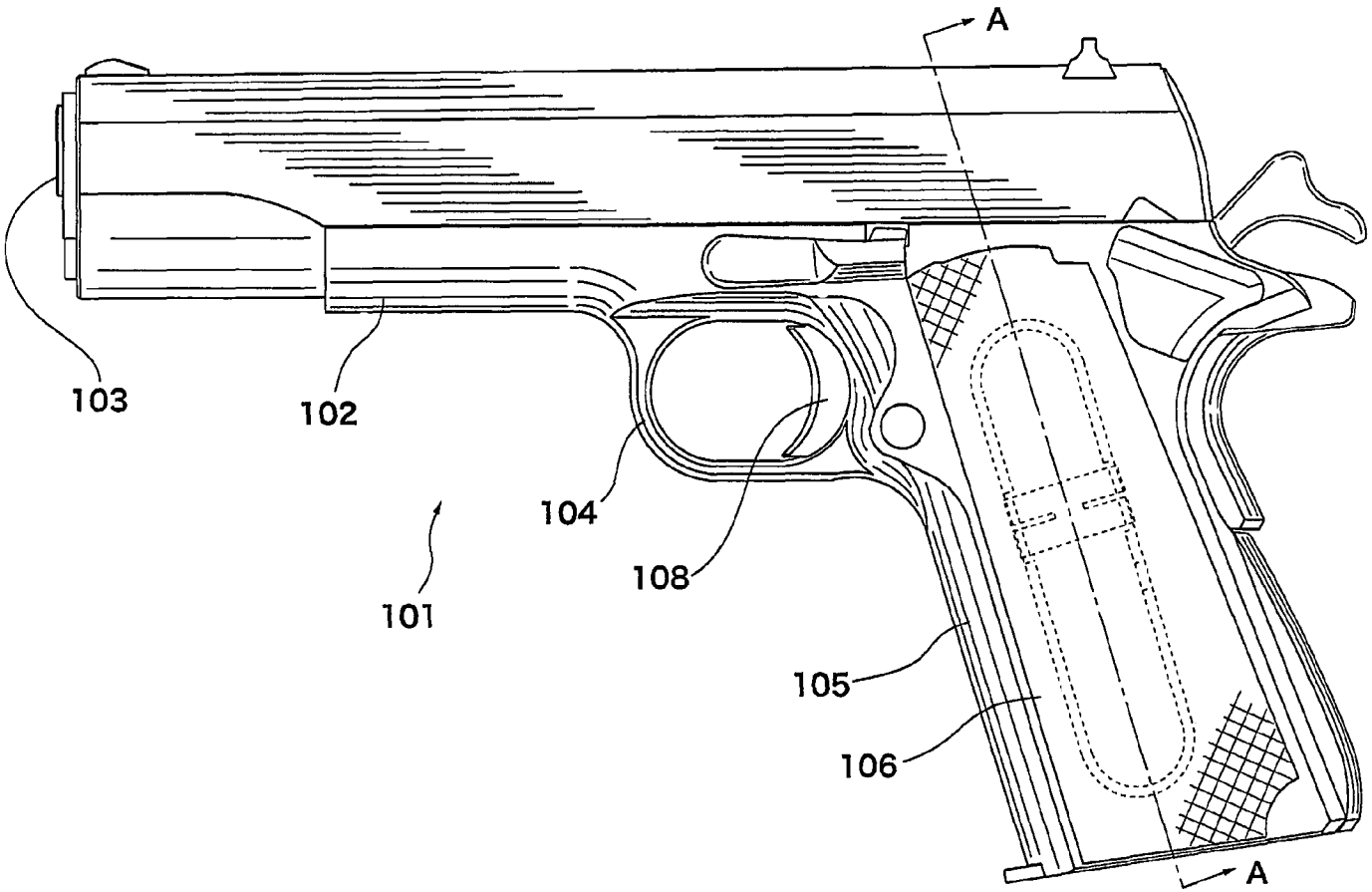
FIG. 1 is a side view of a toy gun.

A description will be given to an embodiment with reference to FIG. 1 to FIG. 13. FIG. 1 is a side view of a toy gun 101. In the following description, the side of the toy gun 101 shown in FIG. 1 may be designated as left side.

The primary shape of the toy gun 101 is formed of a main frame 102. The main frame 102 forms each part, such as a muzzle 103, a trigger guard 104, and a grip 105. A panel 106 is attached to the left side surface of the grip 105. The panel 106 can be freely attached to and detached from the grip 105. A different panel 107 is attached to the right side surface of the grip 105. (Refer to FIG. 11, FIG. 12, and FIG. 13.)

The toy gun 101 includes a trigger 108. The trigger 108 is positioned in a circular space formed by the trigger guard 104. The trigger 108 is moved in the front-rear direction of the toy gun 101.

Figure 2:
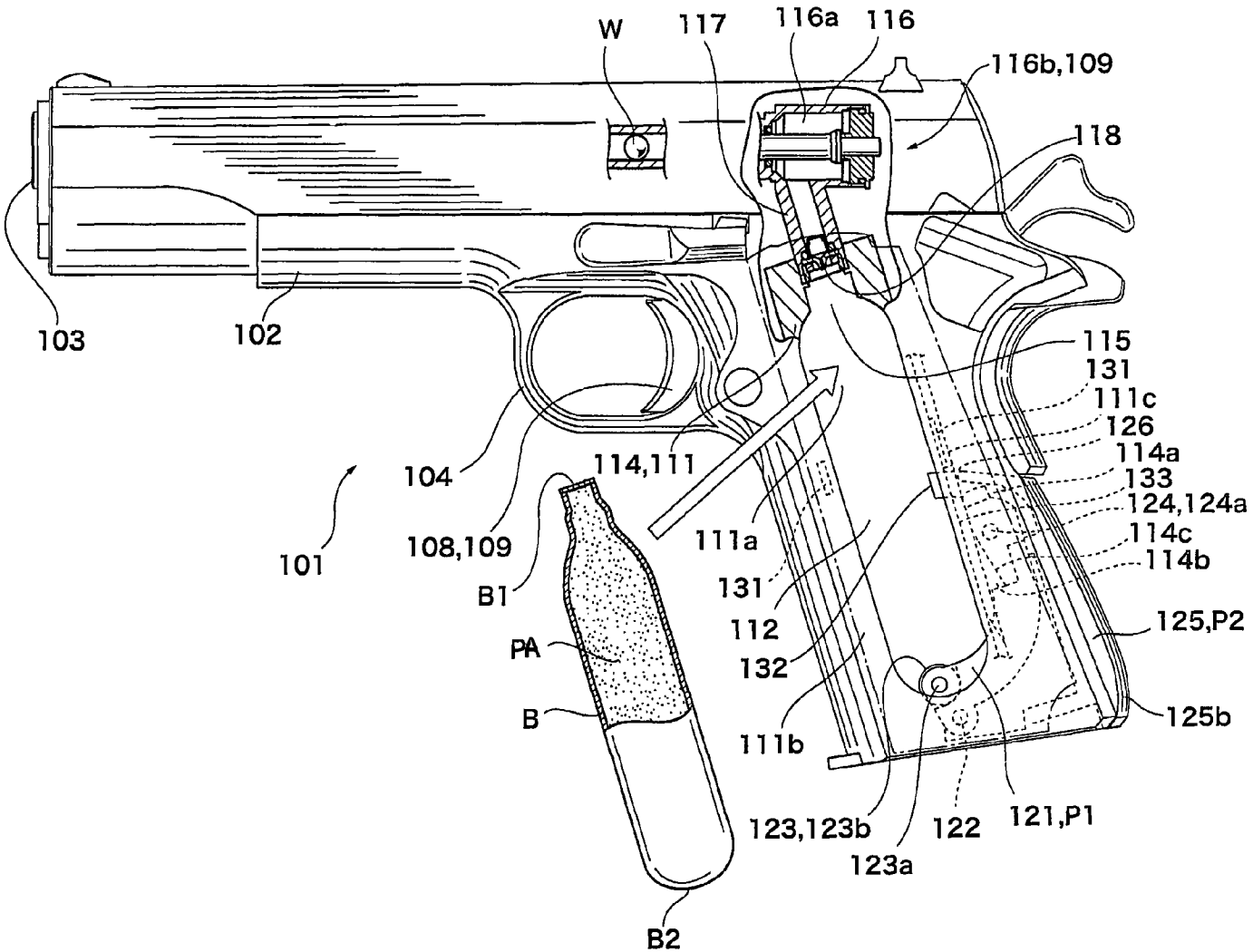
FIG. 2 is a side view of a toy gun with the panel thereof removed.
Figure 3:
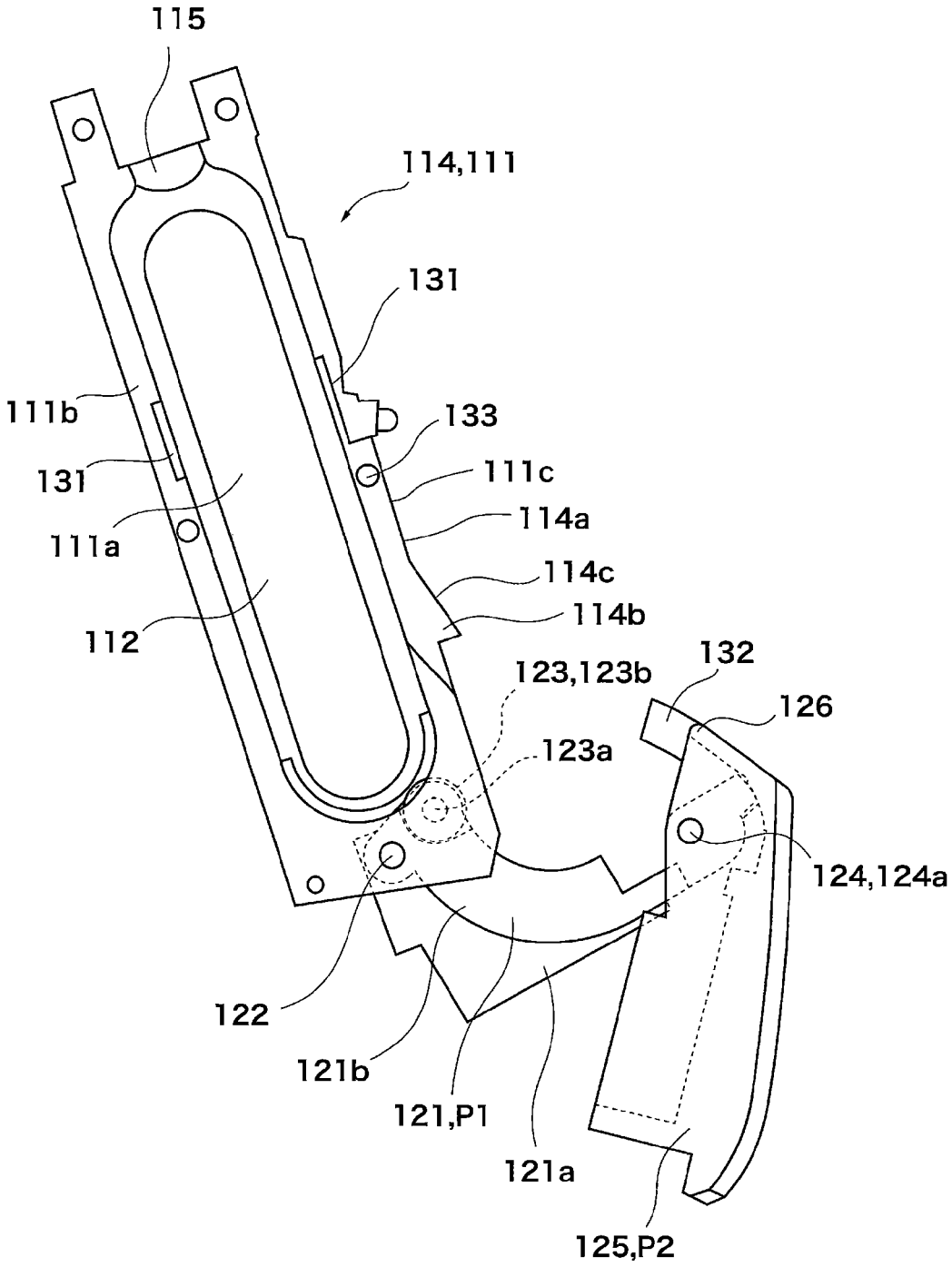
FIG. 3 is a side view of a puncture frame.
Figure 4:
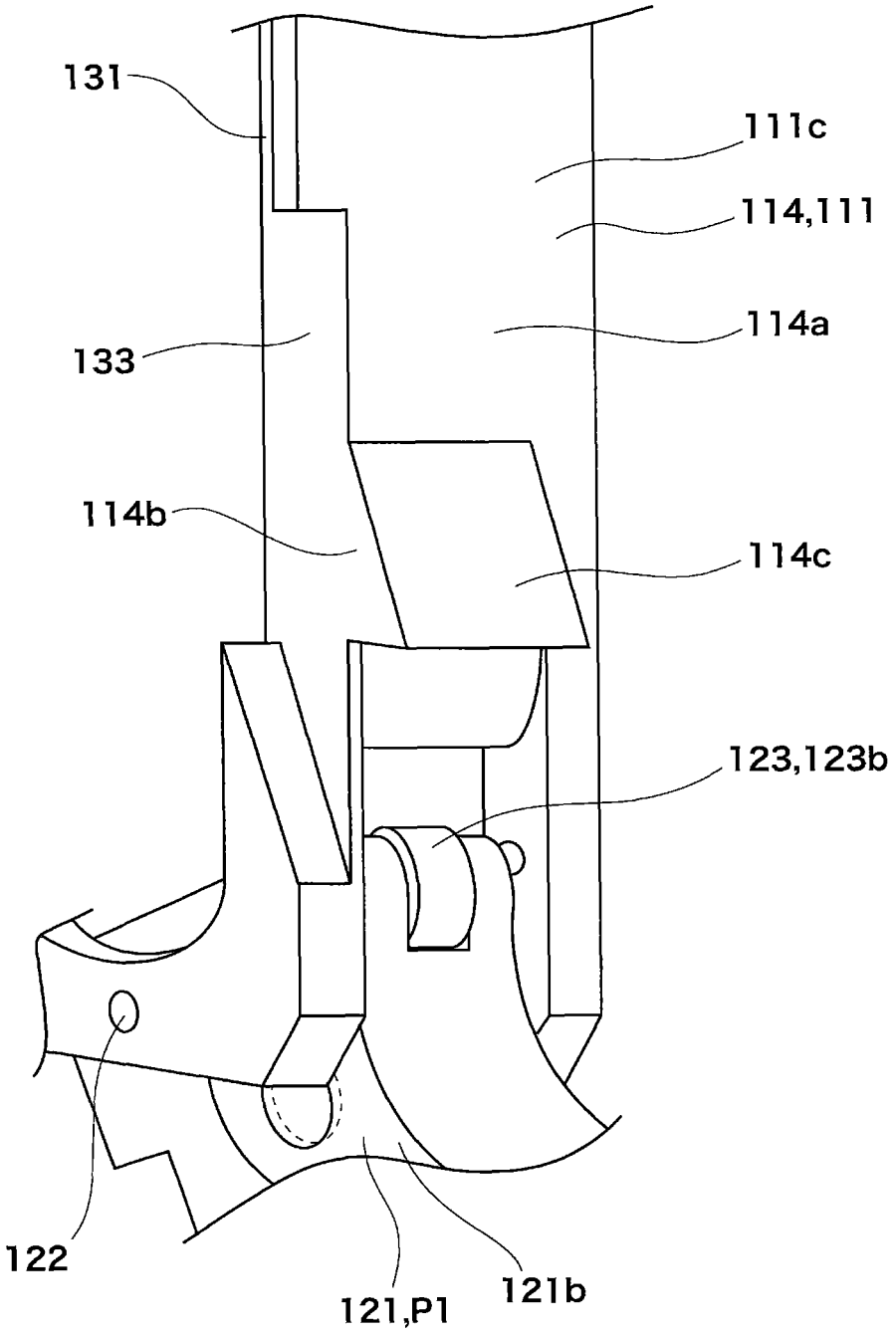
FIG. 4 is a perspective view of a puncture frame and a clamp arm as viewed from the rear side of the toy gun.

FIG. 2 is a side view of the toy gun 101 with the panel 106 removed. FIG. 3 is a side view of a puncture frame 114. FIG. 4 is a perspective view of the puncture frame 114 and a clamp arm 121 as viewed from the rear side of the toy gun 101. FIG. 2, FIG. 3, and FIG. 4 will be referred to. The toy gun 101 includes an air chamber body 116. The air chamber body 116 forms an air chamber **116*a*. The air chamber 116*a* is hermetically closed. In the air chamber 116*a*, compressed gas PA is stored. A cylindrical portion 117 is protruded from the air chamber body 116. The air chamber body 116 is provided with a gas spout mechanism 116*b*. The gas spout mechanism 116*b* discharges compressed gas PA in the air chamber 116*a* toward the muzzle 103 according to the movement of the trigger 108. The discharged compressed gas PA pushes a bullet W loaded in the toy gun 101 and shoots the bullet W out of the muzzle 103. Thus the trigger 108 and the gas spout mechanism 116***b* comprise a discharge mechanism 109.

The toy gun 101 includes a cartridge housing portion 111. The cartridge housing portion 111 is provided in the grip 105 and is comprised of the main frame 102 and the puncture frame 114. Specifically, the puncture frame 114 is fit in the grip 105. The puncture frame 114 is long to the shape of the grip 105. The main frame 102 covers the left side surface of the puncture frame 114 fit in the grip 105. As illustrated in FIG. 2, the main frame 102 does not entirely cover an introduction port 112 (described later).

A cylindrical housing space 111*a* is formed in the cartridge housing portion 111. A cylindrical gas cartridge B is housed in the housing space 111*a*. The gas cartridge B is formed of, for example, a metal material. The gas cartridge B is cylindrical. The gas cartridge B is filled therein with compressed gas PA. Examples of the compressed gas PA are carbonic acid gas, chlorofluorocarbon gas, CFC substitute gas, and the like. One end portion of the gas cartridge B is narrowed and a lid portion B1 is formed at the tip thereof. The lid portion B1 is formed of a film-like material and seals the compressed gas PA in the gas cartridge B. A semi-spherical bottom portion B2 is formed at the other end portion of the gas cartridge B located on the opposite side to the lid portion B1.

The introduction port 112 is formed in the cartridge housing portion 111. The introduction port 112 is open in the left side surface (first face 111*b*) of the grip 105. The introduction port 112 lets the housing space 111*a* and the external space communicate with each other. The gas cartridge B is introduced into the housing space 111*a* through the introduction port 112.

The cylindrical portion 117 is provided therein with a cartridge attachment portion 118. The cartridge attachment portion 118 is in the shape of a hollow needle. The lid portion B1 of the gas cartridge B is stuck onto the cartridge attachment portion 118. The cartridge attachment portion 118 guides compressed gas PA in the stuck gas cartridge B to the air chamber 116*a*.

The rear side surface (second face 111*c*), different from the first face 111*b*, of the cartridge housing portion 111 is formed by the puncture frame 114. A sliding surface 114*a* is formed on the second face 111*c*. The sliding surface 114*a* is not covered with the main frame 102 and is visible from the rear side of the toy gun 101 and is concealed by the clamp arm 121 and a raising lever 125. An inclined portion 114*b* is protruded from the sliding surface 114*a*. The inclined portion 114*b* forms an inclined surface 114*c*. The inclined surface 114*c* is inclined so that the inclined surface is protruded backward as it goes downward.

In another embodiment, the sliding surface 114*a* may not be formed in the puncture frame 114 but may be formed on the side surface of the main frame 102 on the rear side of the toy gun 101. In this case, the rear wall surface of the puncture frame 114 may be exposed on the rear side of the toy gun 101 or may be covered with the main frame 102.

An insertion portion 115 is formed in one end portion of the puncture frame 114. The cylindrical portion 117 is fit into the insertion portion 115.

The clamp arm 121 as first arm element P1 is installed at the end portion of the puncture frame 114 on the opposite side to the insertion portion 115. The clamp arm 121 is in an L shape as laterally viewed. The clamp arm 121 is placed in the area extended from the rear part to the lower part of the grip 105. The portion of the clamp arm 121 positioned on the rear side of the grip 105 will be designated as extended portion 121*a*. The portion of the clamp arm 121 positioned on the lower side of the grip 105 will be designated as lower portion 121*b*. The extended portion 121*a* is extended from the lower portion 121*b* so that the extended portion is opposed to the sliding surface 114*a*.

A rotation shaft 122 couples together the lower portion 121*b* and the portion of the puncture frame 114 located below the cartridge housing portion 111. The clamp arm 121 is rotatable around the axis of the rotation shaft 122. A roller shaft 123*a* is provided in the area in the lower portion 121*b* of the clamp arm 121 located above the rotation shaft 122. The roller shaft 123*a* is extended in parallel with the rotation shaft 122. A roller 123 is installed on the roller shaft 123*a*. The roller 123 is rotatable around the axis of the roller shaft 123*a*. The roller 123 is moved in conjunction with the rotation of the clamp arm 121 and pushes up the bottom portion B2 of the gas cartridge B housed in the cartridge housing portion 111. Thus the roller 123 functions as a pressing portion 123*b*.

Engaging stepped portions 131 are formed in the puncture frame 114. The engaging stepped portions 131 are provided at the edge portion of the introduction port 112 between the insertion portion 115 and the introduction port 112. As the result of the puncture frame 114 being covered with the main frame 102, the engaging stepped portions 131 are turned into grooves. Tab portions 106*d* (described later with reference to FIG. 9 and FIG. 10) are engaged into the engaging stepped portions 131.

Figure 5:
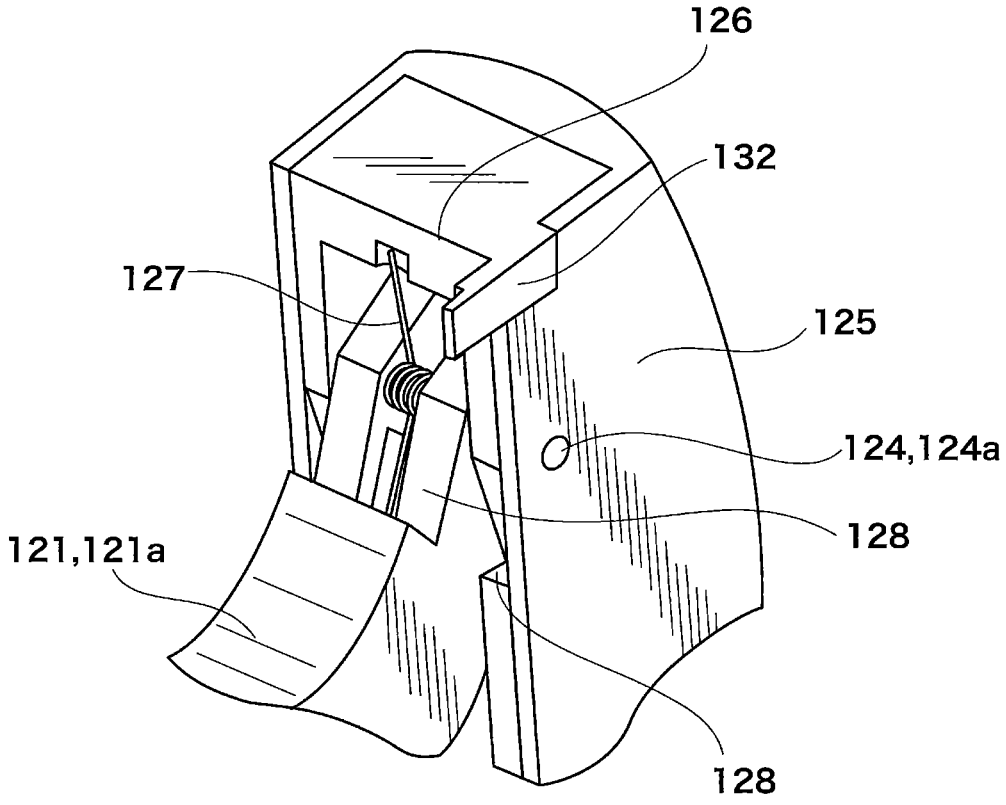
FIG. 5 is a perspective view of a clamp arm and a raising lever as viewed from the front side of the toy gun.
Figure 6:
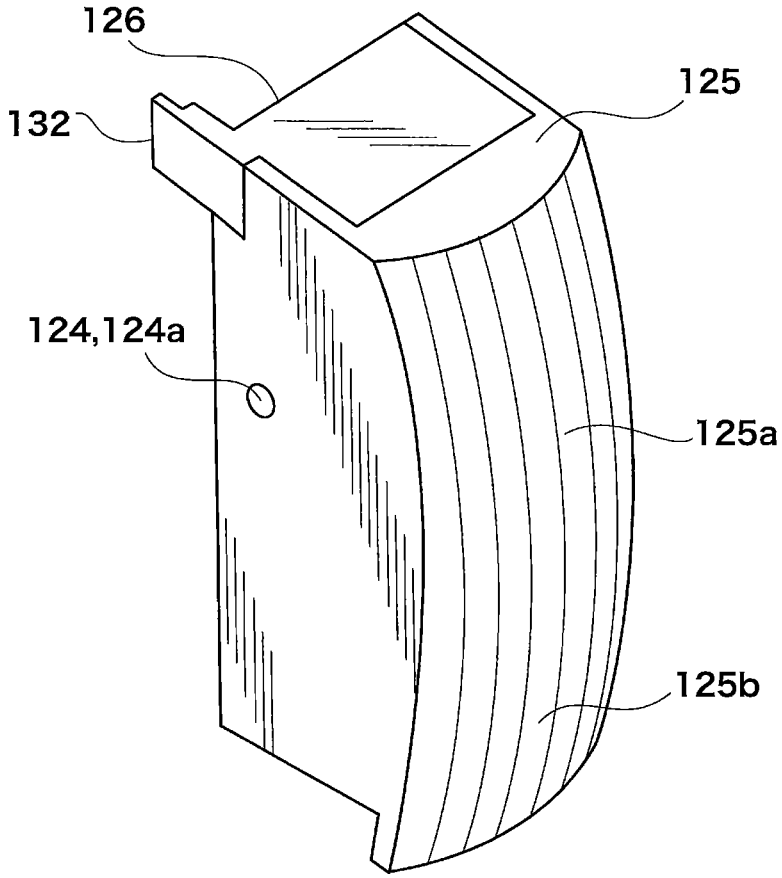
FIG. 6 is a perspective view of a raising lever as viewed from the rear side of the toy gun.

FIG. 5 is a perspective view of the clamp arm 121 and the raising lever 125 as viewed from the front side of the toy gun 101. FIG. 6 is a perspective view of the raising lever 125 as viewed from the rear side of the toy gun 101. FIG. 4, FIG. 5, and FIG. 6 will be referred to. The raising lever 125 as second arm element P2 is installed at the end portion of the clamp arm 121 above the extended portion 121*a* through an installation shaft 124. The raising lever 125 is coupled to the extended portion 121*a* so that the raising lever can be freely rotated around the installation shaft 124. Thus the installation shaft 124 functions as a fulcrum portion 124*a*.

The front side of the upper end of the raising lever 125 functions as an abutment portion 126. The abutment portion 126 slides on the sliding surface 114*a* and the inclined surface 114*c*. A description will be given to this regard later with reference to FIG. 7 and FIG. 8.

A vertical-striped design surface 125*a* is formed on the side surface of the raising lever 125 on the rear side, extending from the upper end to the lower end. The design surface 125*a* is exposed on the rear side of the toy gun 101.

The raising lever 125 has an operation portion 125*b*. The operation portion 125*b* is positioned on the opposite side to the abutment portion 126 with respect to the installation shaft 124. The operation portion 125*b* is extended to below the installation shaft 124 and covers the side surface of the lower portion 121*b* on the rear side. When a user holds and pulls backward the operation portion 125*b*, the operation portion 125*b* is broken away from the extended portion 121*a* and the abutment portion 126 is moved to ahead of the installation shaft 124. A torsion spring 127 is placed so that the torsion spring is wound around the installation shaft 124. The torsion spring 127 pushes backward the portion of the raising lever 125 located above the installation shaft 124. For this reason, when the user releases the operation portion 125*b*, the abutment portion 126 is moved backward and the operation portion 125*b* is brought close to the extended portion 121*a*.

A groove portion 128 agreeing with the shape of the inclined portion 114*b* of the puncture frame 114 is formed both in the clamp arm 121 and in the raising lever 125.

A working portion 132 is provided on the raising lever 125 between the fulcrum portion 124*a* and the abutment portion 126. The working portion 132 is a plate-like portion that is positioned in the abutment portion 126 at the left end portion of the toy gun 101 and is extended from the raising lever 125 to the front side of the toy gun 101.

Figure 7:
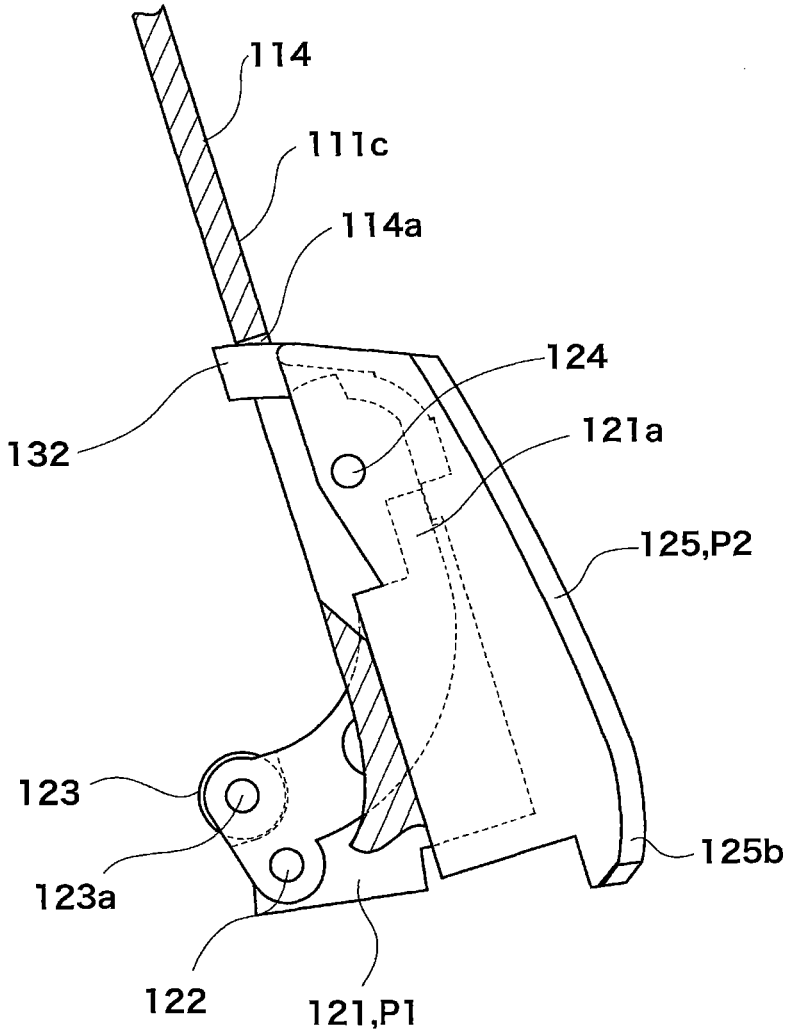
FIG. 7 is a side view of a clamp arm and a raising lever obtained before an operation portion is moved.
Figure 8:
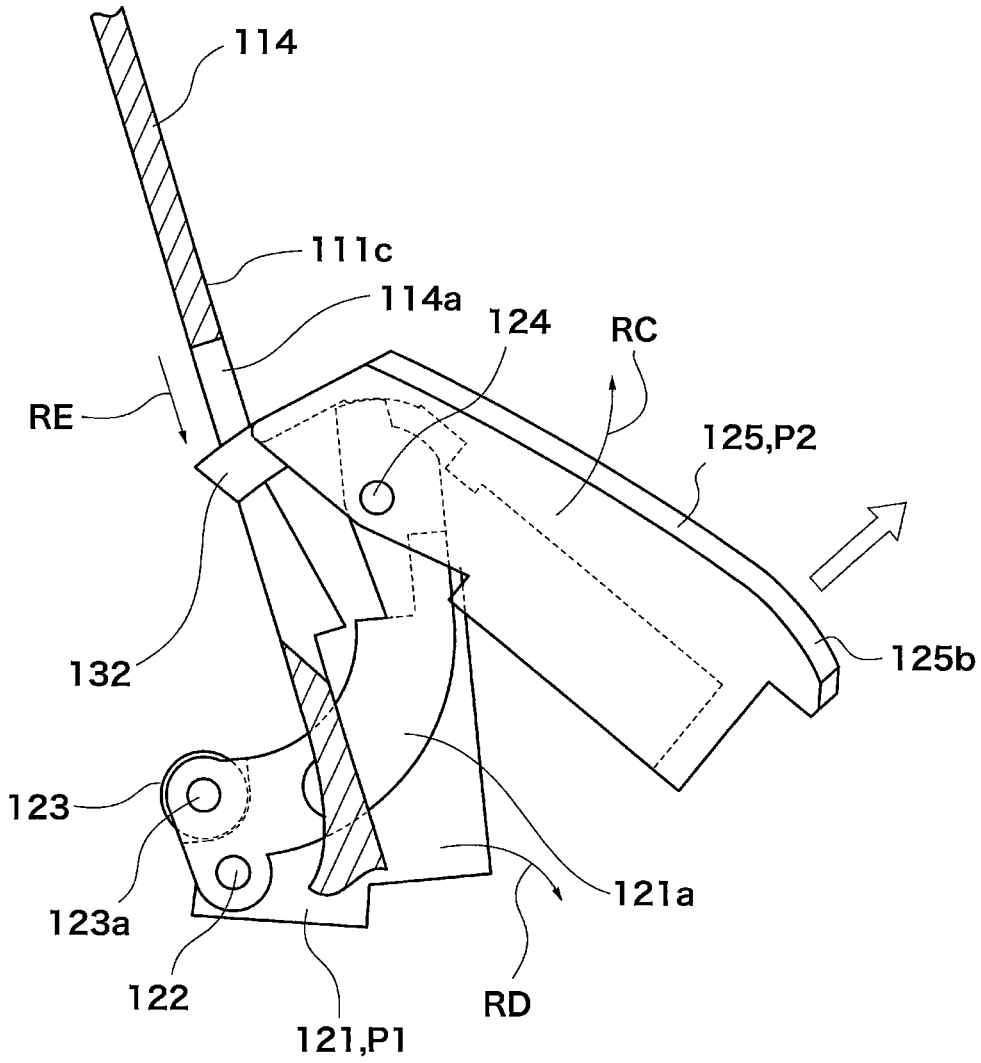
FIG. 8 is a side view of a clamp arm and a raising lever with an operation portion moved.

FIG. 7 is a side view of the clamp arm 121 and the raising lever 125 obtained before the operation portion 125*b* is moved. FIG. 8 is a side view of the clamp arm 121 and the raising lever 125 with the operation portion 125*b* moved. FIG. 7 and FIG. 8 will be referred to. The working portion 132 gets into an operation groove 133 (Refer to FIG. 2, FIG. 3, and FIG. 4 as well) provided in the puncture frame 114. The operation groove 133 is provided at the end portion of the second face 111*c* of the puncture frame 114 on the left side of the toy gun 101 and is extended in the vertical direction. The working portion 132 can be moved along the first face 111*b* in the operation groove 133.

A description will be given to the movement of the clamp arm 121 and the raising lever 125. In FIG. 7, the extended portion 121*a* is in contact with the sliding surface 114*a*. The raising lever 125 is overlapped with the clamp arm 121 and conceals the second face 111*c*. The working portion 132 gets into the operation groove 133 and is positioned at the upper end portion of the operation groove 133. When a user pulls up the operation portion 125*b* to the rear side of the toy gun 101, the raising lever 125 is rotated around the installation shaft 124. As a result, the abutment portion 126 slides downward while in contact with the sliding surface 114*a*. The working portion 132 is moved downward along the first face 111*b*. The extended portion 121*a* is moved backward and broken away from the puncture frame 114. As a result, the clamp arm 121 is rotated backward around the rotation shaft 122.

When the abutment portion 126 is further moved downward, the abutment portion 126 is brought into contact with the inclined surface 114*c* and is further moved to the rear side of the toy gun 101 so that the abutment portion is broken away from the puncture frame 114. As a result, the clamp arm 121 is further rotated backward around the rotation shaft 122. At this time, the operation portion 125*b* of the raising lever 125 is protruded backward from the grip 105 and becomes easy for the user to grasp. The user can pinch the thus protruded operation portion 125*b* and pull the raising lever 125 backward and downward to rotate the clamp arm 121 as shown by the thick arrow in FIG. 8. As the operation portion 125*b* is pulled up, the roller 123 is rotated backward around the rotation shaft 122 and is moved below the cartridge housing portion 111.

The user can also pinch the operation portion 125*b* to overlap the raising lever 125 with the extended portion 121*a* and push upward the clamp arm 121 pulled out backward. In this case, the raising lever 125 and the clamp arm 121 are rotated around the rotation shaft 122. The roller 123 is moved upward and gets into the cartridge housing portion 111.

Figure 9:
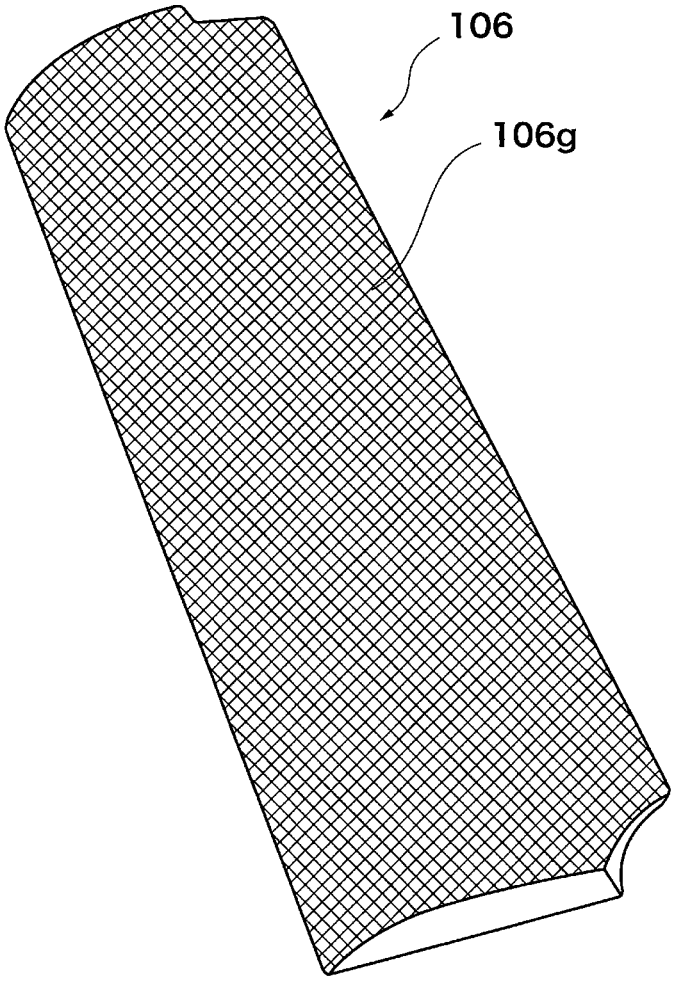
FIG. 9 is a perspective view of the front side of a panel.
Figure 10:
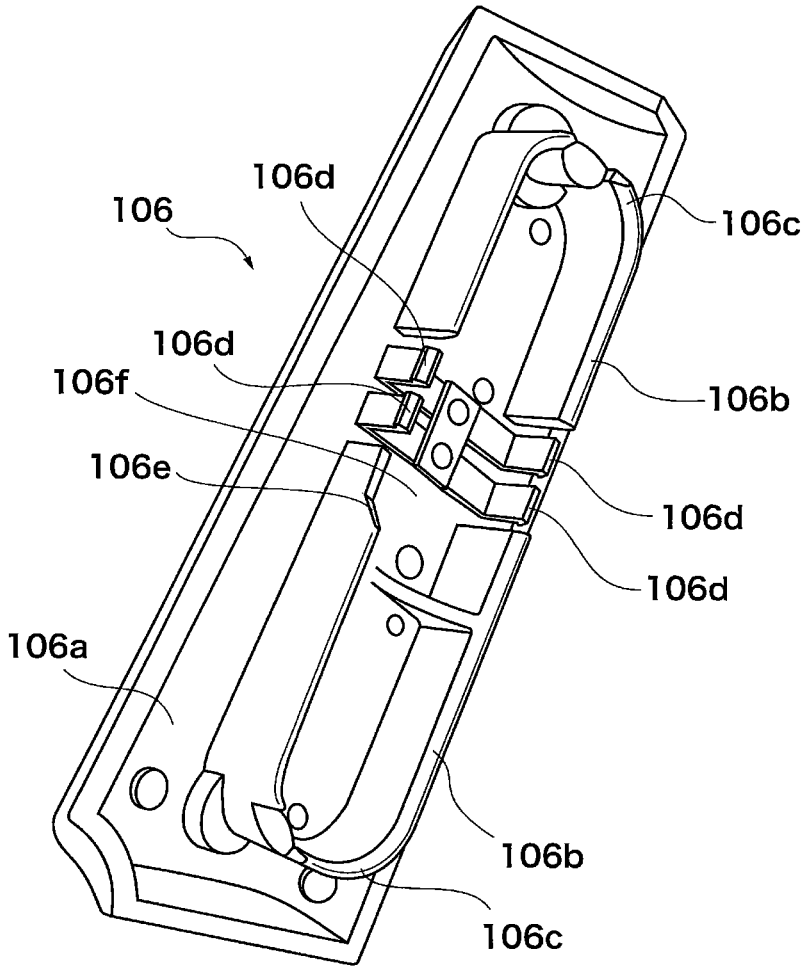
FIG. 10 is a perspective view of the back side of a panel.

FIG. 9 is a perspective view of the front side of the panel 106. FIG. 10 is a perspective view of the back side of the panel 106. FIG. 9 and FIG. 10 will be referred to. The panel 106 is detachably attached to the left side surface of the grip 105 and covers and conceals the introduction port 112. (Refer to FIG. 2 and the like.)

The panel 106 includes a lid portion 106*a* and a protruded portion 106*b*. The lid portion 106*a* is in a vertically long trapezoidal shape and is rounded so that the lid portion is convex on the front side. The lid portion 106*a* is larger than the introduction port 112 and is smaller than a side surface of the grip 105. A design surface 106*g* provided with a design imitating a real gun is formed on the front side of the lid portion 106*a*. The protruded portion 106*b* is protruded from the lid portion 106*a* to the back side of the panel 106. The protruded portion 106*b* is in the shape of an oval short cylinder. The tab portions 106*d* are provided between the two circular portions 106*c* of the protruded portion 106*b*. The tab portions 106*d* are engaged into the engaging stepped portions 131. (Refer to FIG. 2, FIG. 3, FIG. 4, and the like.) In the protruded portion 106*b*, the area adjoining to a tab portion 106*d* is provided with an inclined portion 106*e*. The inclined portion 106*e* forms a recessed portion 106*f* recessed from the tip of the protruded portion 106*b* toward the lid portion 106*a*. The inclined portion 106*e* is inclined to the lid portion 106*a* and is opposed to the recessed portion 106*f*.

FIG. 2 will be referred to again. With this toy gun 101, a user introduces a gas cartridge B from the introduction port 112 into the cartridge housing portion 111. When the toy gun 101 is in use or storage, the panel 106 is attached to the grip 105 and the lid portion 106*a* of the panel 106 closes the introduction port 112. For this reason, it is required to remove the panel 106 to introduce a gas cartridge B into the cartridge housing portion 111. Hereafter, a description will be given to the relation between the panel 106 and the introduction port 112 and the attachment/detachment of the panel to/from the grip 105 with reference to FIG. 2, FIG. 8, FIG. 11, FIG. 12, and FIG. 13.

Figure 11:
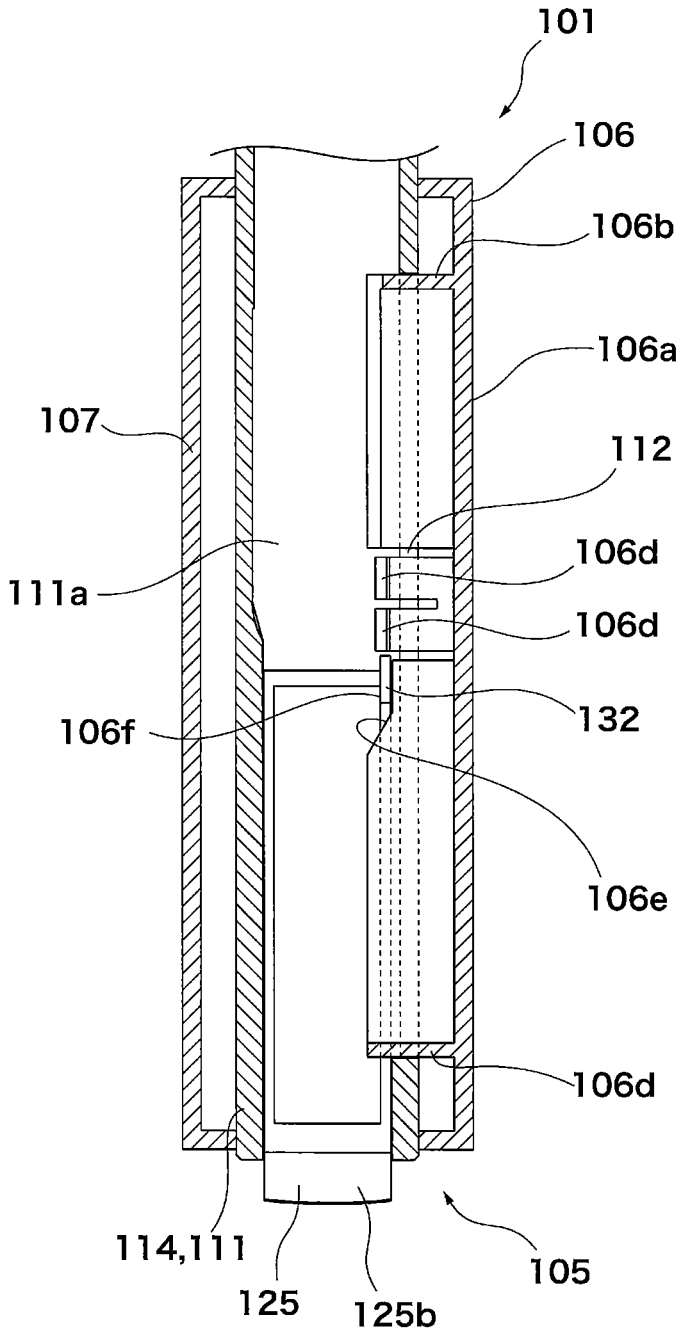
FIG. 11 is a sectional view taken along line A-A of FIG. 1 with a panel attached.

FIG. 11 is a sectional view taken along line A-A of FIG. 1 with the panel 106 attached. With the panel 106 attached to the grip 105, the lid portion 106*a* covers the introduction port 112. A part of the protruded portion 106*b* on the tip side is passed through the introduction port 112 and is positioned in the housing space 111*a*. The tab portions 106*d* are engaged into the engaging stepped portions 131 to prevent the panel 106 from dropping off. The raising lever 125 is positioned along the sliding surface 114*a* of the puncture frame 114. The working portion 132 is positioned in the recessed portion 106*f*.

Figure 12:
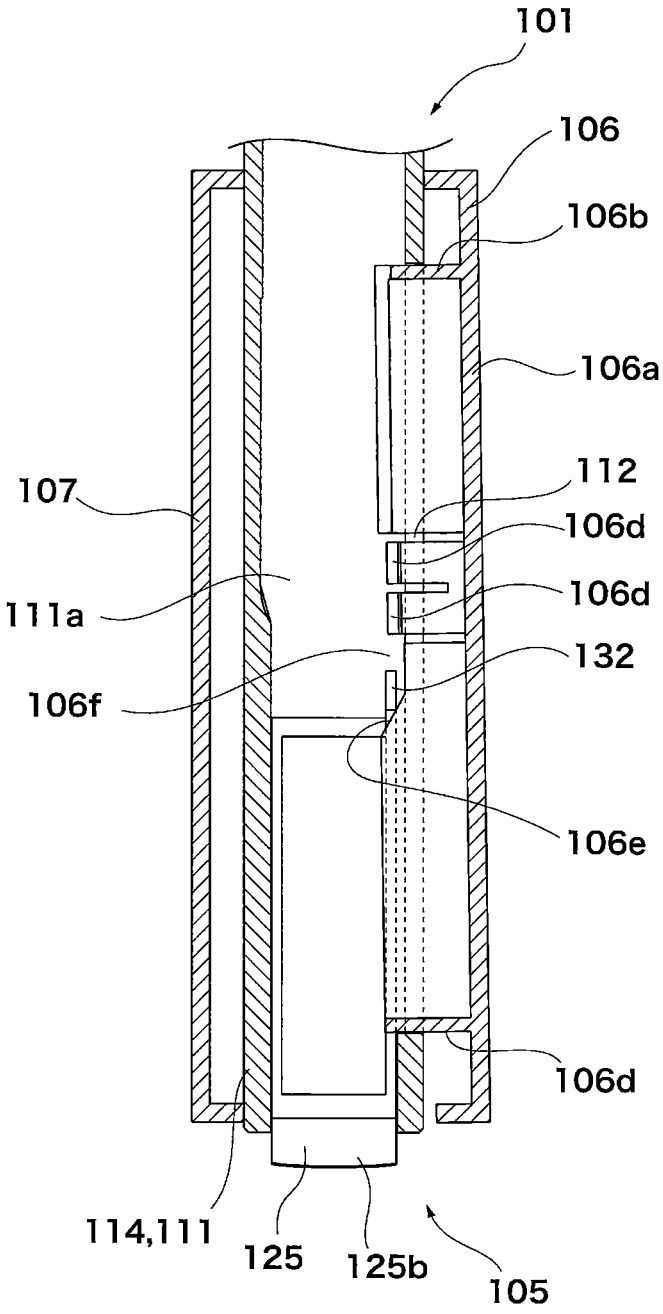
FIG. 12 is a sectional view taken along line A-A of FIG. 1 with an operation portion moved.

FIG. 12 is a sectional view taken along line A-A of FIG. 1 with the operation portion 125*b* moved. FIG. 8 and FIG. 12 will be referred to. To remove the panel 106 from the grip 105, first, the user pulls up the operation portion 125*b* of the raising lever 125 to the direction indicated by the arrow RC in FIG. 8. As a result, the raising lever 125 is rotated around the installation shaft 124 relative to the clamp arm 121. The abutment portion 126 slides along the sliding surface 114*a* and the inclined surface 114*c* and is moved downward. The clamp arm 121 is rotated around the rotation shaft 122 to the direction indicated by the arrow RD in FIG. 8. As a result, the roller 123 is rotated around the rotation shaft 122 and is retreated from the cartridge housing portion 111.

Attention will be paid to the working portion 132. The working portion 132 is moved to the direction indicated by the arrow RE in FIG. 8 in the operation groove 133 in conjunction with the movement of the abutment portion 126. As a result, the working portion 132 is brought into slide contact with the inclined portion 106*e*. When the working portion 132 is further moved to the direction indicated by the arrow RE, the working portion 132 pushes the inclined portion 106*e* and pushes up the inclined portion 106*e* toward the introduction port 112. As the result of the working portion 132 pushing the inclined portion 106*e*, the tab portions 106*d* are disengaged from the engaging stepped portions 131. (Refer to FIG. 2, FIG. 3, FIG. 4, and the like). As a result, the lower end portion of the panel 106 is broken away from the puncture frame 114.

Figure 13:
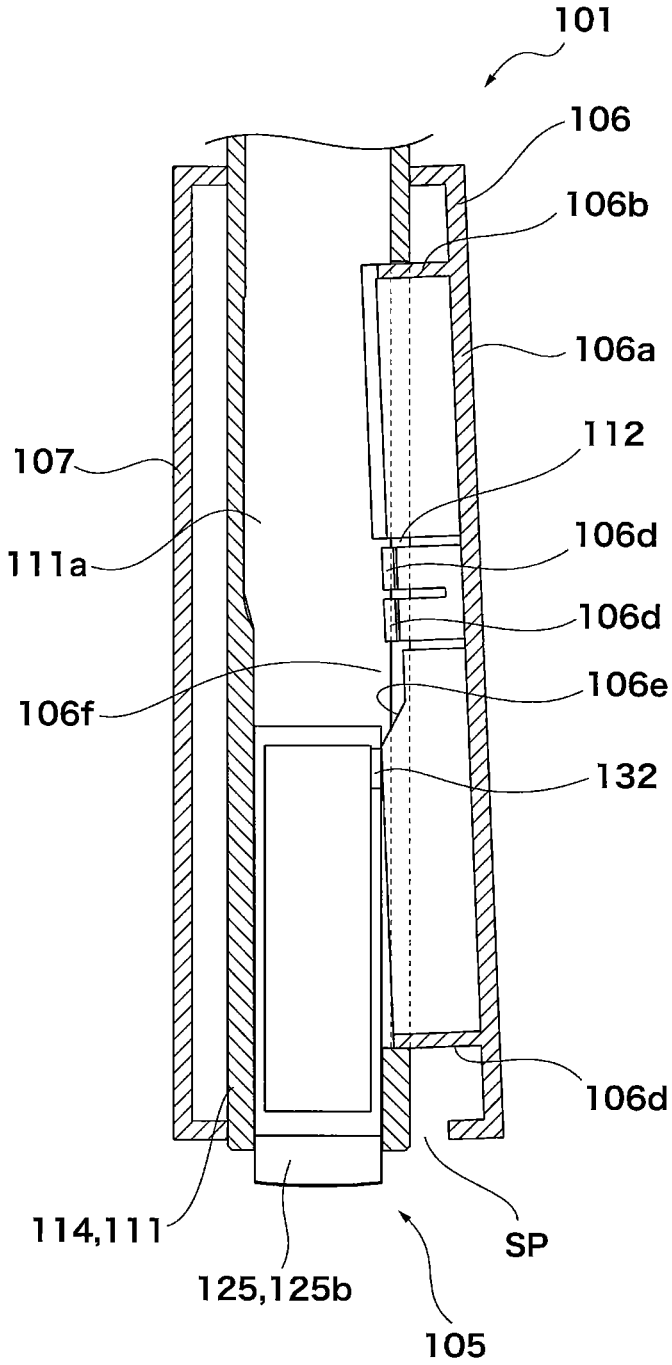
FIG. 13 is a sectional view taken along line A-A of FIG. 1 with the operation portion further moved, following FIG. 12.

FIG. 13 is a sectional view taken along line A-A of FIG. 1 with the operation portion 125*b* further moved, following FIG. 12. FIG. 8 and FIG. 13 will be referred to. When the working portion 132 is further moved to the direction indicated by the arrow RE, the working portion 132 continues to move the panel 106 and is eventually broken away from the recessed portion 106*f*. As a result, a gap SP is formed between the lower end portion of the panel 106 and the puncture frame 114. The user can get his/her finger into the gap SP and remove the panel 106 from the grip 105 to expose the housing space 111*a*.

FIG. 2 will be referred to again. With the housing space 111*a* exposed, the user introduces a gas cartridge B from the introduction port 112 and houses the gas cartridge B in the housing space 111*a*. At this time, the lid portion B1 of the gas cartridge B is opposed to the cartridge attachment portion 118. The bottom portion B2 of the gas cartridge B is opposed to the roller 123.

The user subsequently inserts the protruded portion 106*b* into the introduction port 112 and engages the tab portions 106*d* into the engaging stepped portions 131 to attach the panel 106 to the grip 105. The user overlaps the raising lever 125 with the clamp arm 121 and brings the extended portion 121*a* of the clamp arm 121 into contact with the sliding surface 114*a*. As a result, the roller 123 is rotated around the rotation shaft 122 and is brought into contact with the bottom portion B2 of the gas cartridge B. When the raising lever 125 is further moved, the roller 123 rolls along the bottom portion B2 of the gas cartridge B and pushes the gas cartridge B upward. As a result, the lid portion B1 is pierced by the cartridge attachment portion 118 and the compressed gas PA in the gas cartridge B gets into the air chamber 116*a*.

With the cartridge attachment portion 118 stuck into the lid portion B1, the user pulls the trigger 108. As a result, the gas spout mechanism 116*b* is actuated and the compressed gas PA in the air chamber 116*a* spouts out toward the muzzle 103. The spouted-out compressed gas PA pushes a bullet W loaded in the toy gun 101 and shoots the bullet W out of the muzzle 103. Even when the panel 106 is not attached to the grip 105, the bullet W is fired.

Consideration will be given to a case where the quantity of compressed gas PA in the gas cartridge B is reduced and the pressure of compressed gas PA in the air chamber 116*a* becomes insufficient to fire a bullet W. (Refer to FIG. 4.) In this case, the user removes the panel 106 from the grip 105 in accordance with the above-mentioned procedure, moves the roller 123, and takes the gas cartridge B out of the housing space 111*a*. The user subsequently attaches a new gas cartridge B to the housing space 111*a*, moves the roller 123, and attaches the panel 106 to the grip 105.

According to the toy gun 101 in this embodiment, the working portion 132 is brought into slide contact with the inclined portion 106*e* and pushes out the panel 106 and the panel 106 is removed from the cartridge housing portion 111. For this reason, it is possible to easily attach/detach the panel 106 attached to the toy gun 101 and concealing the gas cartridge B. Since the inclined portion 106*e* is positioned in the cartridge housing portion 111, the appearance of the toy gun 101 is not impaired.

The toy gun 101 in this embodiment includes the clamp arm 121 (first arm element P1) and the raising lever 125 (second arm element P2). The working portion 132 is provided in the raising lever 125 between the installation shaft 124 and the abutment portion 126. The distance between the abutment portion 126 and the operation portion 125*b* is longer than the distance between the abutment portion 126 and the fulcrum portion 124*a*. For this reason, the user only has to apply small force to remove the panel 106. Since the operation portion 125*b* is brought far away from the cartridge housing portion 111, the user can easily pinch the raising lever 125.

In the toy gun 101 in this embodiment, the roller 123 (pressing portion 123*b*) pushes the gas cartridge B to attach the lid portion B1 of the gas cartridge B to the cartridge attachment portion 118. When the user moves the raising lever 125, the gas cartridge B is smoothly and reliably attached to the cartridge attachment portion 118.

What is claimed is:

1. A toy gun comprising:

an air chamber body forming an air chamber for storing compressed gas;

a discharge mechanism discharging compressed gas in the air chamber;

a cartridge housing portion forming a housing space for housing a gas cartridge filled with compressed gas;

a cartridge attachment portion to which a gas cartridge housed in the cartridge housing portion is coupled and which guides compressed gas in the gas cartridge to the air chamber;

an introduction port which is provided in a first face of the cartridge housing portion and through which the gas cartridge introduced into the housing space is passed;

a working portion provided in the cartridge housing portion and moving in a direction along the first face;

a panel having a lid portion closing the introduction port and a protruded portion protruded from the lid portion and detachably attached to the cartridge housing portion with the protruded portion inserted into the introduction port; and an inclined portion which is provided in the protruded portion and with which the working portion is brought into slide contact, wherein, the protruded portion is formed as a wall and includes a first protruded part extending perpendicularly from the lid portion at a first distance and a second protruded part extending perpendicularly from the lid portion at a second distance being greater than the first distance with the inclined portion disposed between and interconnecting the first and second protruded parts as a unitary construction.

2. The toy gun according to claim 1, further comprising:

a first arm element coupled to the cartridge housing portion and brought close to or away from a second face, different from the first face, of the cartridge housing portion; and a second arm element including an abutment portion slid on the second face, a fulcrum portion rotatably coupled to the first arm element, and an operation portion positioned on the opposite side to the abutment portion with respect to the fulcrum portion, wherein the working portion is provided in the second arm element and projects forwardly of the abutment portion.

3. The toy gun according to claim 2, further comprising:

a pressing portion pushing a gas cartridge housed in the cartridge housing portion toward the cartridge attachment portion in conjunction with the displacement of the first arm element.

* * * * *